United States Patent [19]

Kicherer et al.

[11] Patent Number: 5,028,762

[45] Date of Patent: Jul. 2, 1991

[54] ELECTRIC HOTPLATE

[75] Inventors: Robert Kicherer; Felix Schreder, both of Oberderdingen, Fed. Rep. of Germany

[73] Assignee: E.G.O. Elektro-Gerate Blanc u. Fischer, Fed. Rep. of Germany

[21] Appl. No.: 488,315

[22] Filed: Mar. 5, 1990

[30] Foreign Application Priority Data

Mar. 4, 1989 [DE] Fed. Rep. of Germany ..... 3907029

[51] Int. Cl.[5] ..... H05B 3/70

[52] U.S. Cl. ..... 219/458; 219/443

[58] Field of Search ..... 219/458, 459, 457, 463, 219/464, 443

[56] References Cited

U.S. PATENT DOCUMENTS

| | | | |
|---|---|---|---|
| 1,093,754 | 4/1914 | Ball | 219/458 |
| 3,612,827 | 10/1971 | Dills | 219/467 |
| 3,739,149 | 6/1973 | Fischer | 219/464 |
| 3,797,375 | 3/1974 | Cerola | 219/464 |
| 4,363,956 | 12/1982 | Scheidler | 219/464 |
| 4,388,519 | 6/1983 | Dooley | 219/459 |
| 4,490,603 | 12/1984 | Fischer | 219/459 |

FOREIGN PATENT DOCUMENTS

| | | | |
|---|---|---|---|
| 594984 | 3/1960 | Canada | 219/443 |
| 1907554 | 9/1964 | Fed. Rep. of Germany . | |
| 7005532 | 2/1970 | Fed. Rep. of Germany . | |
| 7121622 | 6/1971 | Fed. Rep. of Germany . | |
| 8528062 | 10/1985 | Fed. Rep. of Germany . | |
| 8717025 | 6/1988 | Fed. Rep. of Germany . | |
| 149499 | 4/1955 | Sweden | 219/443 |
| 154815 | 6/1956 | Sweden | 219/457 |
| 171875 | 6/1960 | Sweden | 219/443 |
| 307266 | 5/1955 | Switzerland | 219/443 |
| 1093485 | 12/1967 | United Kingdom | 219/443 |
| 2194720 | 3/1988 | United Kingdom . | |

*Primary Examiner*—Teresa J. Walberg

*Attorney, Agent, or Firm*—Eckert, Seamans, Cherin & Mellott

[57] ABSTRACT

For an electric hotplate (2) is provided an assembly arrangement (1) using a bearing ring (10), which forms a continuous, one-piece, smooth-surface top extending from the outermost circumferential area of the hotplate body (23) located close to the cooking surface (24) to its outer circumference or to the mounting plate (3) and has a relatively shallow collecting depression (13) for liquid which has flowed over between an inner and an outer ring profile (11, 12). With the hotplate or bearing ring can be associated at least one shield and at least one locking and/or centering device for position fixing purposes, so that there is a simple and positionally accurate assembly. The bearing ring (10) can also be stop-limited towards the bottom against deformation.

51 Claims, 10 Drawing Sheets

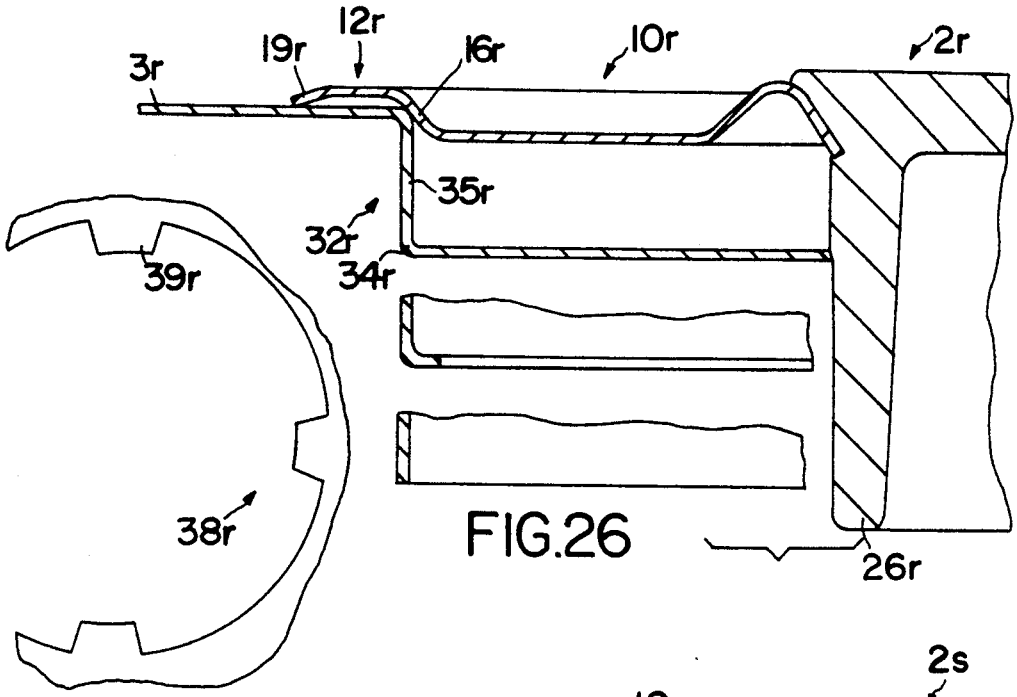
FIG.26
FIG.27
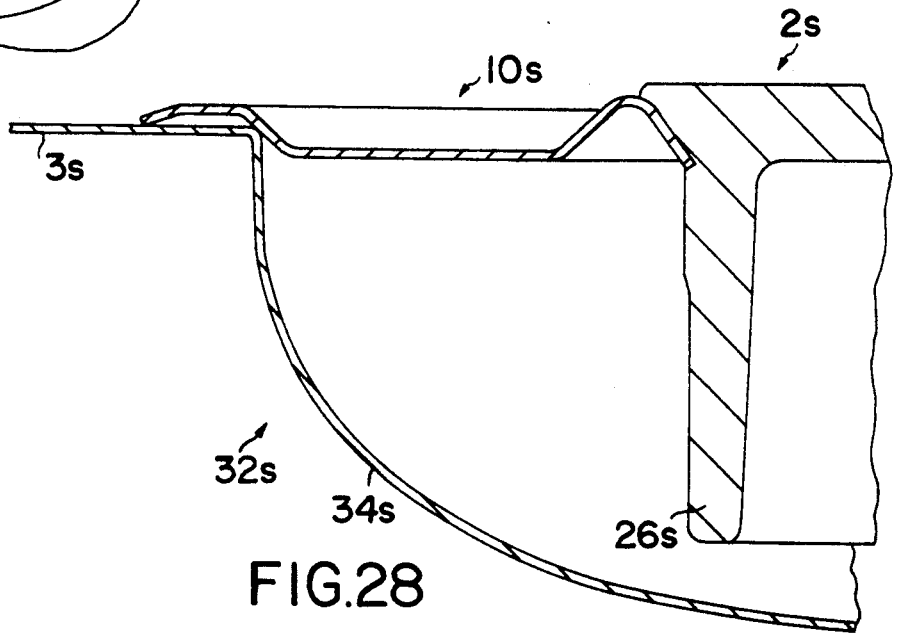
FIG.28
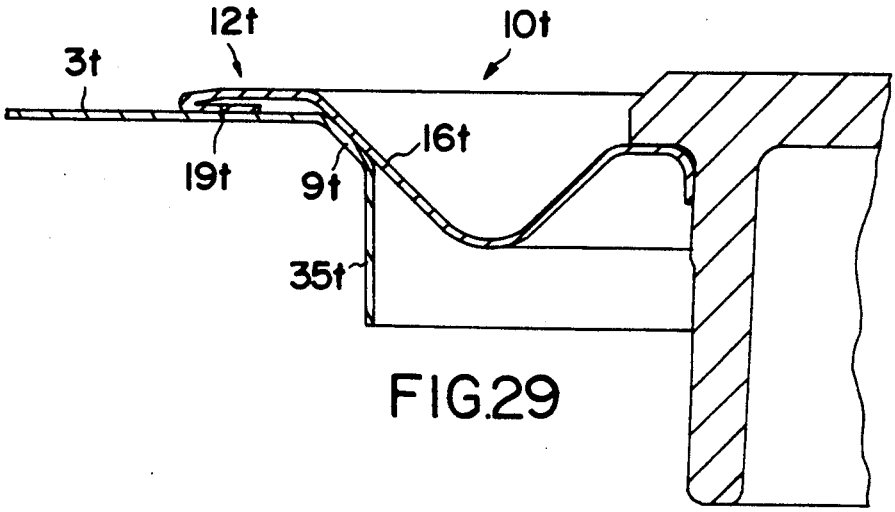
FIG.29

ELECTRIC HOTPLATE

FIELD OF THE INVENTION

The invention relates to an electric hotplate or assembly arrangement for at least one electric hotplate having a cooking surface on the top of a hotplate body and on the underside a support surface of a bearing ring for supporting on the opening rim of a mounting plate. The bearing ring can pass through in one piece between the hotplate body and the support surface.

SUMMARY OF THE INVENTION

An object of the invention is to provide an arrangement or electric hotplate of the aforementioned type through which, in the case of simple construction and easy fitting, a reliably supporting and sealing reception of the hotplate in a mounting plate is made possible in such a way that the cooking surface of the hotplate is also only slightly below the top of the mounting plate.

According to the invention this object is achieved in that means are provided producing a substantially one-part, bearing connection between the hotplate body and the mounting plate. At least over a part of the circumferential zone surrounding the electric hotplate connected radially to the outer circumference of the cooking surface is formed a depression or recess in such a way that in this area there are no parts projecting upwards over the cooking surface. Thus, even in the case of cooking vessels projecting over the cooking surface and whose bottom is slightly lower in the marginal area, there is no risk of them rising up outside the outer circumference of the cooking surface, so that there is always a complete supporting action on the cooking surface only.

The depression is constructed as a channel-like collecting depression, which is optionally segmentally subdivided over the circumference, e.g. for boiling over liquid or the like and is bounded on one or both lateral flanks by vertical wall portions. These flanks appropriately rise in shallow manner and at the most by an angle of approximately 45°. The depression can be cross-sectionally hollow tray-like, curved arcuately approximately over its entire width and/or V-shaped, or can have a mixed form of two or more of these basic forms or shapes.

Advantageously with the bearing ring is associated at least one locking member for the easy detachable locking against the raising of the hotplate from the mounting plate. Despite a direct, downwardly braced locking of the hotplate body, the actual bearing ring is directly locked with respect to the mounting plate, so that it cannot be drawn upwards when raising a stuck cooking vessel in the outer marginal area. It is particularly advantageous if the locking member is not formed by a bolt or the like, but by a snap member, a joggling or bending plate or tongue, etc. The locking member can be substantially constructed in one piece with a sheet metal part, which can be the actual bearing ring or at least a separate sheet metal part, which is appropriately positively connected to the bearing ring, e.g. by a fold connection.

The inventive electric hotplate can be installed in mounting plates made from temperature-sensitive materials, because the bearing ring can have a relatively large ring width, in such a way that it adequately emits the thermal energy directly supplied by the hotplate body over said width and up to engaging with the mounting plate. Appropriately there are additional means for the heat shielding of the mounting plate or the edge of the mounting opening with respect to the electric hotplate. These means can be constructionally combined with the locking member or members, so that no separate components are required. A lower, cover-like termination for the hotplate body can also be constructionally combined with the shield or formed by the latter.

A particularly advantageous construction of an assembly or hob arrangement is obtained if the mounting plate has a reduced thickness or is stepped in the vicinity of bearing ring engagement. It can then have on the top a recessed ring or circular shoulder. The bearing ring need only extend approximately up to the outer circumference of the hotplate body at a maximum to the plane of the top of the mounting plate and forms a planar or flush continuation of the base surface of the mounting plate.

According to the invention means are provided for the additional supporting of the bearing ring between the mounting plate and the electric hotplate, said means connecting to the mounting plate and/or hotplate or can be located in spaced manner from one or both of these components.

As a result of the described constructions or other configurations, the sheet metal components can have a very considerable strength, despite the limited sheet metal thickness, and can optionally be constructed in closed continuous manner without interruptions. The shield can be formed in dish-shaped manner in the vicinity of one, two or more electric hotplates and consequently form a bottom, substantially closed reception depression for the hotplate. At least one corresponding depression can also be provided on the mounting plate, particularly if it is made from sheet metal. In the vicinity of the hotplate, the mounting plate can be completely free from openings, or forms on the underside of the hotplate a substantially closed shield, or a lower cover for the hotplate body. For ventilation from below, the space below the bearing ring, over at least part of the hotplate height, can be downwardly open substantially over the entire width.

The invention also provides centring means, which bring about a reciprocal centring between the hotplate on the one hand and at least one of the components surrounding it on the other. The surrounding component can be a shield, a lower cover essentially limited to the electric hotplate, the mounting plate, etc. Particularly if said component is made from sheet metal, the centring member can be shaped out in one piece, e.g. in the form of a freely projecting tongue, which directly faces with its terminal edge an outer circumferential surface of the hotplate body.

The invention is particularly suitable for so-called mass hotplates. Within an outer flange edge or between the latter and a corresponding, radially inner flange edge at least one helical heating resistor is provided on the underside of the hotplate body. Roughly in the centre or within the inner flange edge and the heating resistor, the hotplate body has a downwardly projecting pin, in which can engage clamping means for the downwardly directed bracing of the electric hotplate or the bearing ring. The hotplate can also have a different construction, e.g. it can be relatively flat and plate-like and provided on the underside with a laminated heating resistor. It is also conceivable for the electric hotplate heating means to be constituted by a tubular heater, which optionally at least partly forms the hotplate body in such a way that the top of its tubular casing directly serves as the cooking surface. It is also conceivable to form the cooking surface by a translucent single glass ceramic or similar plate, on whose underside the heating system is e.g. constituted by a radiant heater and which is inserted in the mounting plate as a closed constructional unit with a bearing ring.

BRIEF DESCRIPTION OF THE DRAWINGS

Embodiments of the invention are described in greater detail hereinafter relative to the drawings, wherein are shown:

FIGS. 19 to 26 Further embodiments in views corresponding to FIG. 1.

FIG. 27 A detail from FIG. 26 in a view from below.

FIGS. 28 to 34 Further embodiments in views corresponding to FIG. 1.

DETAILED DESCRIPTION OF THE PREFERRED EMBODIMENTS

Figure 1:
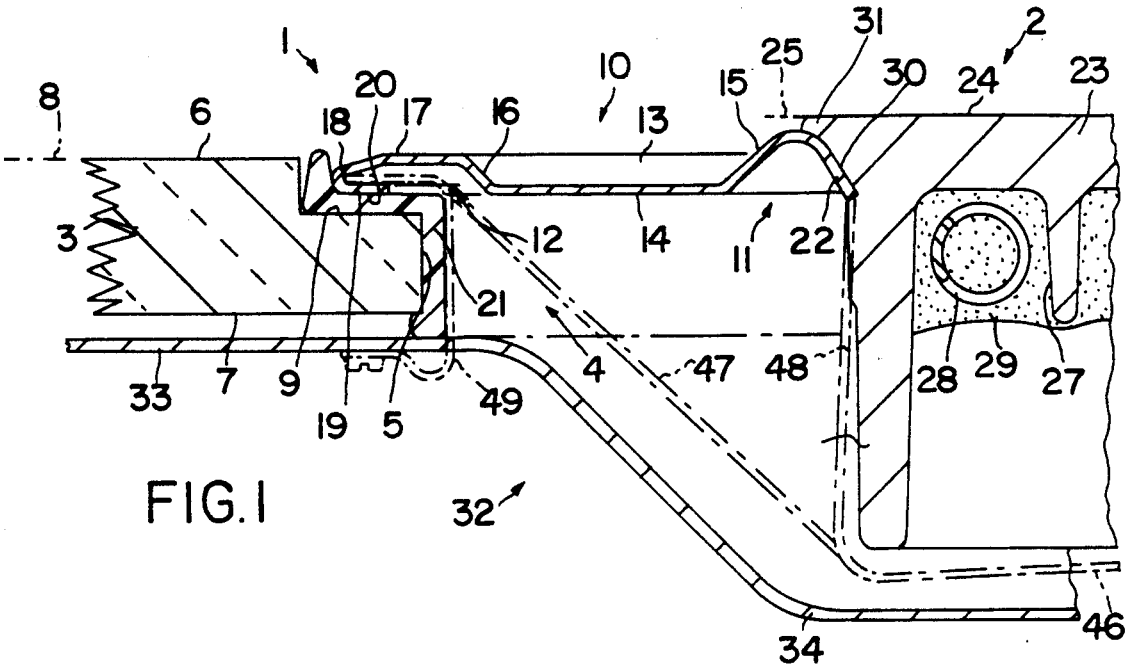
FIG. 1 A detail of an inventively arranged electric hotplate in vertical section.

The inventive assembly arrangement 1 according to FIG. 1 is used for the ready-for-use reception of an electric hotplate 2 in the vicinity of a mounting opening 4 of a mounting plate 3 which is much larger than the outer circumference of hotplate 2 and which can e.g. be a kitchen working surface, cooker hob, etc. The inner circumference 5 of the mounting opening 4 is substantially cylindrically bounded and traverses the mounting plate 3 between the top 6 and the bottom 7. The top 6 defines as a standing or base surface the generally substantially horizontal standing or base plane 8 of mounting plate 3. Top 6, following on to the mounting opening 4, is provided with a ring or circular shoulder 9 offset by less than half the plate thickness and whose step width is greater than its step height and smaller than the plate thickness.

For the at least partial supporting of the hotplate 2 with respect to the weight forces which occur and in particular for the uninterrupted, closed connection of the outer circumference of hotplate 2 to the mounting plate 3 is provided a thin sheet metal, particularly stainless steel bearing ring 10, which although profiled, is substantially flat and ring-like. It is located entirely below the cooking surface 24 of hotplate 2 and below the bottom 7 or the bearing surface formed by the ring shoulder 9 is roughly in the plane of the upper, plate-like solid part of hotplate 2.

The bearing ring 10 forms a radially inner ring profile 11, constructed in one piece therewith, bounding its inner circumference and which is constructed cross-sectionally downwardly in ring slot open manner or in downwardly diverging V-form with a rounded V-tip. The highest profile apex is a few millimeters below the cooking surface 24 and slightly above the base plane 8. The bearing ring 10 has a radially outer, integrally constructed outer ring profile 12 forming its outer circumference and which engages by part of its profile width over the mounting plate 3 following on to the mounting opening 4. Between the two ring profiles 11, 12 is provided a ring profile forming a collecting depression 13, which is constructed in through, flat, channel-like manner over the circumference. Its bottom 14 is substantially continuously planar and on each side passes outwards by a flank 15 or 16 under an angle of more than 15°, particularly approximately 45°. The width of the depression 13 is several times and in particular more than five times greater than its depth. The radially inner flank 15 is directly formed by the associated V profile leg of ring profile 11. The outer flank 16 passes into a ring disk-like, substantially planar edge 17, whose top which is slightly deeper than the highes apex of ring profile 11 is roughly located in the base plane 8. The depression 13 has different heights on both sides, namely it is higher on the radial inside than the radial outside.

In the radial outer region, edge 17 drops at a shallow angle outwards under a few radians and passes via an approximately U-shaped fold 18 into a circular, radially inwardly directed and preferably ring disk-like, planar fold leg 19. Its ring width is significantly smaller than the shoulder width of shoulder 9. The fold leg 19 roughly in the plane of base 14 surrounds the ring profile forming the depression 13 with a radial spacing and forms with its underside a ring disk-like support surface 20 for supporting with respect to the mounting plate 3 or ring shoulder 9.

Between the bearing ring 10 or its outer ring profile 12 and the mounting plate 3 or ring shoulder 9 is arranged a prefabricated profile washer 21 made from a rubber elastic, substantially heat-resistant material, engaging in substantially full surface manner on ring shoulder 8 with a profile web and has profile legs connected to this web for engaging on the vertical shoulder surface and on the inner circumference 5 of mounting plate 3. The profile washer 21 can also have a short profile web engaging below the underside of mounting plate 3, so that from the inside of mounting opening 4 it positively engages round the mounting plate 3 against forces at right angles to base plane 8 and consequently upward movements are prevented. The profile washer 21, which can be made from rubber, outwardly and inwardly covers the edges in substantially gap-free manner and forms an expansion compensating element. The fold 18 and fold leg 19 engage under pretension on the top of the profile web associated with the ring shoulder 9 and on the inner circumference of the upwardly directed profile leg. The profile washer 21 is locked in its assembly position, namely against radial constriction. The profile washer 21 can also be bonded with respect to the mounting plate 3 and/or bearing ring 10 can be locked by bonding against mounting plate 3 or profile washer 21. The upper profile leg of profile washer 21 appropriately extends at the furthest up to the base plane 8. From top 6 to edge 17 or to depression 13 there is a continuous, planar and substantially uninterrupted base or standing surface.

The electric hotplate 2 has a cast iron hotplate body 23, whose upper, substantially plate-like area forms the cooking surface, which defines a setting plane 25, located roughly in the plane of the base surface 8 or only a few millimeters and in particular less than 10 or 7 mm or preferably less than 5 mm above the base plane 8.

Set back slightly radially inwards compared with its largest outer circumference defined by the cooking surface 24, the hotplate body 23 has a flange edge 26 projecting over its underside and which projects downwards over the bottom 7 of mounting plate 3. Within the flange edge 26, hotplate body 23 is provided on the underside with one or more reception slots 27, whose bottom faces are formed by the underside of the plate-like part. Adjacent spiral turns of this reception slot 27 are separated from one another by a spiral web in each case and this projects downwards by less than the flange edge 26. A helical heating resistor 28 is inserted in contact-free manner in slot 27 and is completely embedded in a moulded insulating material 29.

In the vicinity of the plate-like part of the hotplate body 23 or roughly level with the base surface of the reception slot 27, the outer circumference of flange edge 26 passes via a small reentrant ring shoulder into an acute-angled, upwardly conically widened connecting surface 30, on which engages with a positionally fixed seating and in substantially whole-surface manner, a corresponding circular connecting leg 22 of the inner profile ring 11 of bearing ring 10. This frustum-shaped, downwardly tapered connecting leg 22, which essentially has the same conicity as the connecting surface 30, is formed by the radially inner profile leg of the V-shaped profile ring 11 and passes directly into the apex of said ring 11. In the vicinity of the cooking surface 24, the hotplate body 23 is provided on the outer circumference with a few mm thick ring bead 31 projecting slightly outwards over the connecting surface 30 and this is namely by a thickness which is smaller than the spacing between the base plane 8 and the setting plane 25. Ring bead 31 overlaps the profile ring 11 almost up to the apex and is rounded on its circumferential edge. Thus, the profile ring 11 is positively fixed with respect to the hotplate body 23 in both directions of the central axis of hotplate 2 at right angles to cooking surface 24. Connecting leg 22 extends downwards only to roughly level with the bottom 14 or slightly below it, so that the complete bearing ring 10 is located substantially within the plane of the upper, plate-like part of the hotplate body 23.

To bring about a covering of the assembly arrangement on the underside and/or for protecting heat-sensitive components, a shield 32 is provided, which is appropriately formed by at least one sheet metal component and which is located substantially completely below the base plane 8 or the underside of mounting plate 3. In the vicinity of the latter the shield 32 forms a shield plate 33 at a limited distance below bottom 7 and parallel to the latter or mounting plate 3 and which can project inwards over the inner circumference 5 of mounting opening 4 and/or can engage in substantially sealed manner on the lower profile leg of profile washer 21. In the vicinity of hotplate 2 the one-part shield 32 forms a shield dish 34, which projects downwards with respect to the mounting plate 33 and in which the hotplate body 23 engages in such a way that the flange edge 26 is at a limited distance above the substantially planar dish bottom. The dish bottom can be centrally provided with a through opening for a clamp bolt or the like, which engages in a centre stud of hotplate body 23. It is also conceivable for at least part of the weight forces to be absorbed by the hotplate 2 to be absorbed by the direct supporting of hotplate body 23 on the bottom. The dish bottom passes into the shield plate 33 via an upwardly obtuse-angled, conically widened dish casing located below bearing ring 10.

Figure 2:
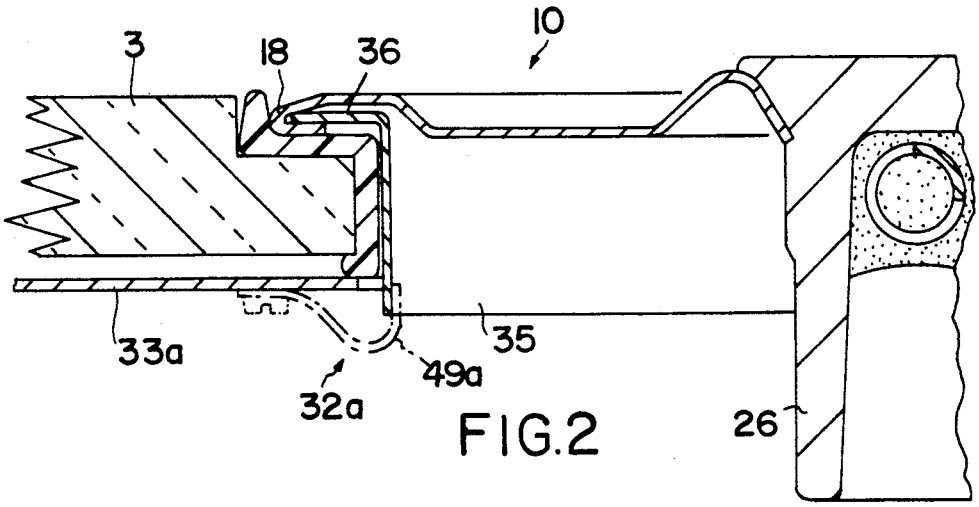
FIGS. 2 to 4 Further embodiments in views corresponding to FIG. 1.

In FIG. 2 shield **32*a* is formed by separate components, namely a shield casing 35 and a shield plate 33*a*, which have a through opening relatively closely adapted to the outer circumference of the shield casing 35 and which is traversed by the latter. The shield casing 35 forms a closed means with the bearing ring 10 and is fixed with its fold 18. At its top end, the shield casing 35 has an outwardly bent, substantially planar collar 36, which is fixed positively between the fold leg and the collar 36 is positioned directly below edge 17. The shield casing 35 surrounds the central ring profile forming the depression 13 with a limited spacing and its outer circumference is immediately adjacent to or engages on the inner circumference of the associated profile leg of profile washer 21. As the shield casing 35 is open to the full width at the lower end, the bearing ring 10 is ventilated from below, the lower end of the shield casing 35 being located above the flange edge 26**.

In the embodiment according to FIG. 3 the separate component is formed by a shield dish **34*a*, whose bottom is located directly below the much shorter flange edge 26*a* of hotplate body 23*a* only projecting slightly downwards over the insulating material 29 and passes via a rounded transition portion into the substantially cylindrical shield casing 35*a*. The latter, with the collar 36*a*, is fixed in the described manner to the bearing ring 10. Shield plate 33*a* is constructed in substantially the same way as in FIG. 2 and is traversed by the shield dish 34*a***.

Figure 4:
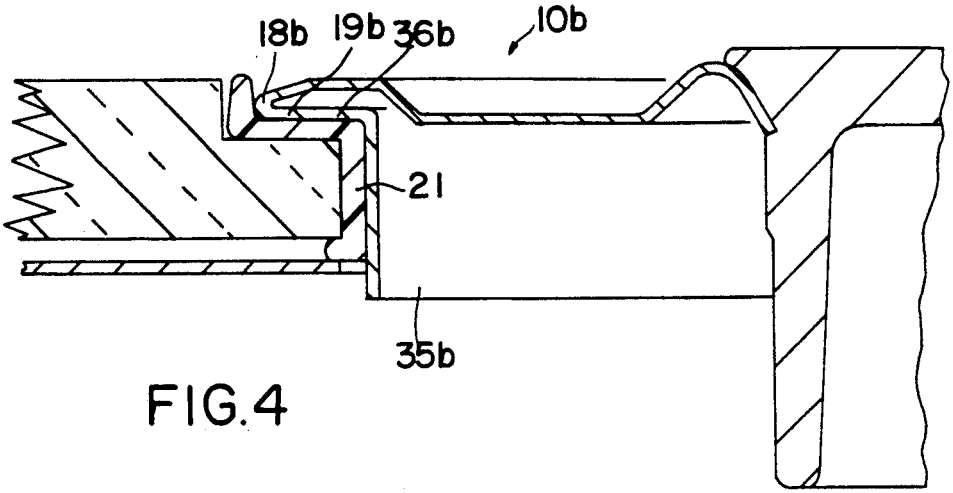

In FIG. 4 the shield casing **35*b* is constructed substantially in one piece with the bearing ring 10*b* or its collar 36*b* is located in the plane of fold leg 19*b*. Both parts either pass in one piece into one another or are interconnected by butt welding in the vicinity of fold 18*b*. Shield casing 35*b* can engage with relatively high radial pressing on profile washer 21, so that this prevents the raising of the bearing ring 10*b*** with a high frictional action.

Figure 5:
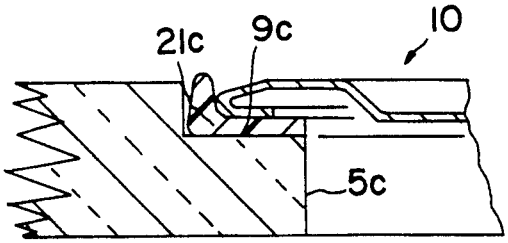
FIG. 5 Another embodiment in a still smaller detail form compared with FIG. 1.
Figure 7:
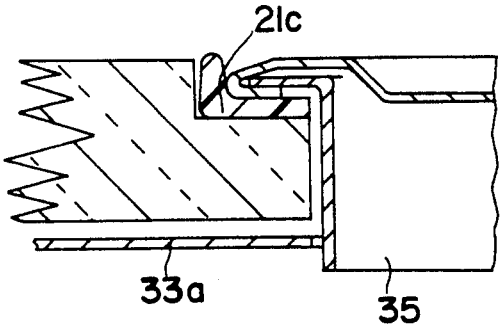
FIGS. 6 to 8 Three further embodiments in views corresponding to FIG. 5.
Figure 6:
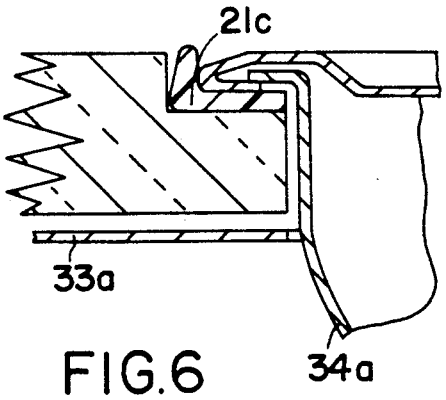
Figure 8:
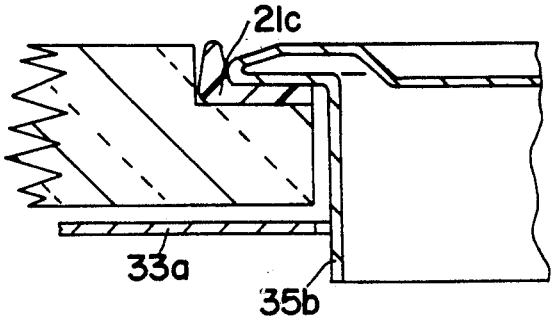

FIG. 5 essentially corresponds to FIG. 1, but the profile washer **21*c* is cross-sectionally substantially angular, so that it approximately is located exclusively within the ring shoulder 19*c* and does not cover the inner circumferential surface 5*c*. The same profile washers 21*c* are also provided in FIGS. 6 to 8. The bearing ring and shield in FIG. 6 are similar to FIG. 3, in FIG. 7 similar to FIG. 2 and in FIG. 8 similar to FIG. 4**. Therefore the mounting opening can have a relatively small diameter.

Figure 9:
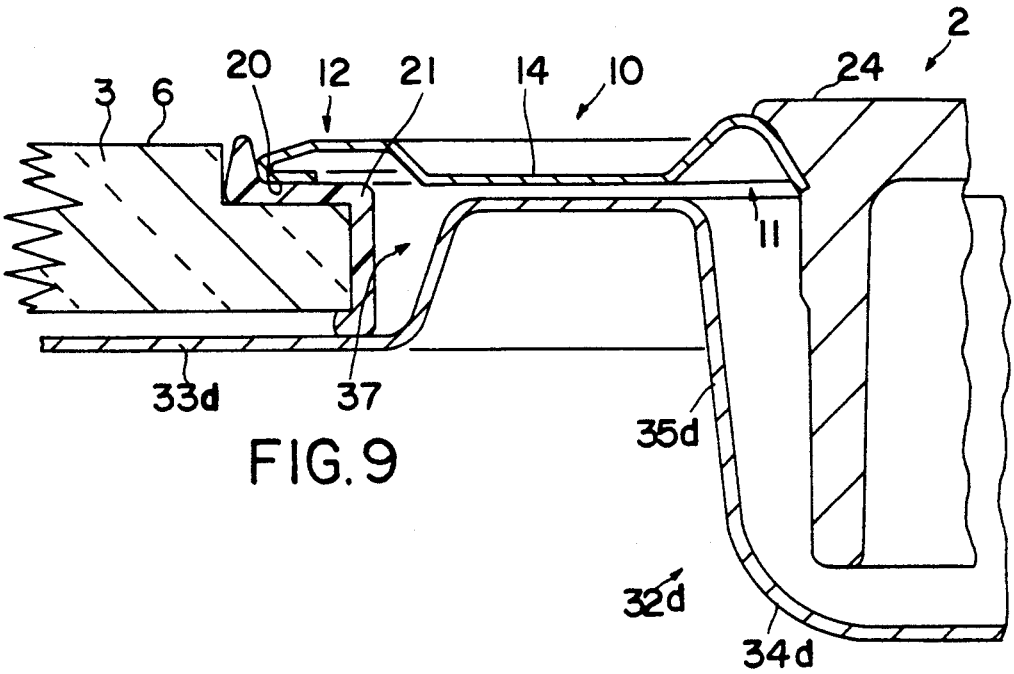
FIGS. 9 to 12 Further embodiments in views corresponding to FIG. 1.

In FIG. 9 an additional lower support is provided for the profile area of bearing ring 10 located between the ring profiles 11, 12, so that it essentially only serves as a support for bottom 14. The support is at a limited distance below the underside of bearing ring 10, so that the latter only strikes in the case of a corresponding weight loading and sagging on the top of the support and is consequently fixed. This spacing can roughly correspond to the vertical spacing between cooking surface 24 and the top 6 of mounting plate 3, so that in the case of a correspondingly high weight loading the hotplate 2 can admittedly drop to the plane of the plate top 6, but not any lower and consequently it is easy to move heavy cooking vessels.

The support is essentially formed by a circular support part 37 positioned below the bearing ring 10 and which is constructed in one piece with the shield plate **33*d* or the shield casing 35*d* of shield dish 34*d* as a sheet metal profile. Shield casing 35***d* extends upwards over and beyond the shield plate 33*d*, so that the hotplate 2 is circumferentially shielded almost uninterruptedly by shield 32*d* and bearing ring 10 with respect to the inner circumference of the mounting plate 3. By means of a casing part immediately adjacent to the inner circumference of profile washer 21, shield plate 33 can pass into support part 37, or said casing part can, as shown, be located with a larger radial spacing within the profile washer 21.

Figure 10:
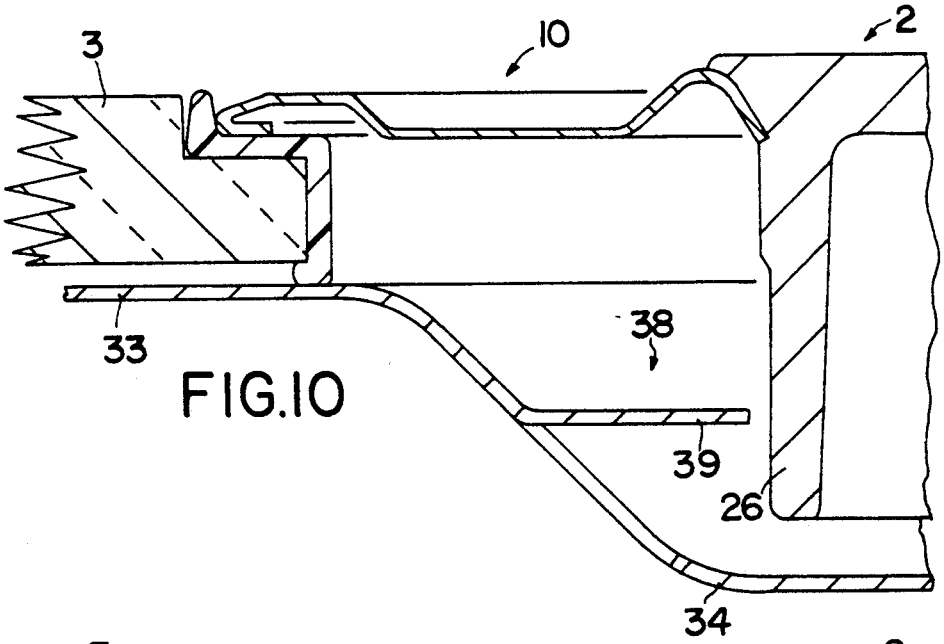

FIG. 10 shows a centring device 38 for centring the hotplate 2 or bearing ring 10 relative to the mounting plate 3. It engages outside the centre of hotplate 2, namely on its outer circumference formed by flange edge 26 and in spaced manner below the bearing ring 10 and heating resistor. In obtuse angled manner, several and in particular at least three tongue-like centring members are bent in one piece out of the casing of the shield dish 34 or shield plate 39 and can be distributed evenly over the circumference of hotplate 2. The centring members 39 roughly parallel to the cooking surface have their free ends bent upwards and said free ends are immediately adjacent to the outer circumference of flange edge 26 below the centre of its height, so that they can also absorb tilting movements of the hotplate 2. All the centring members 39 are appropriately in one plane. Otherwise the construction according to FIG. 10 essentially corresponds to that of FIG. 1.

Figure 3:
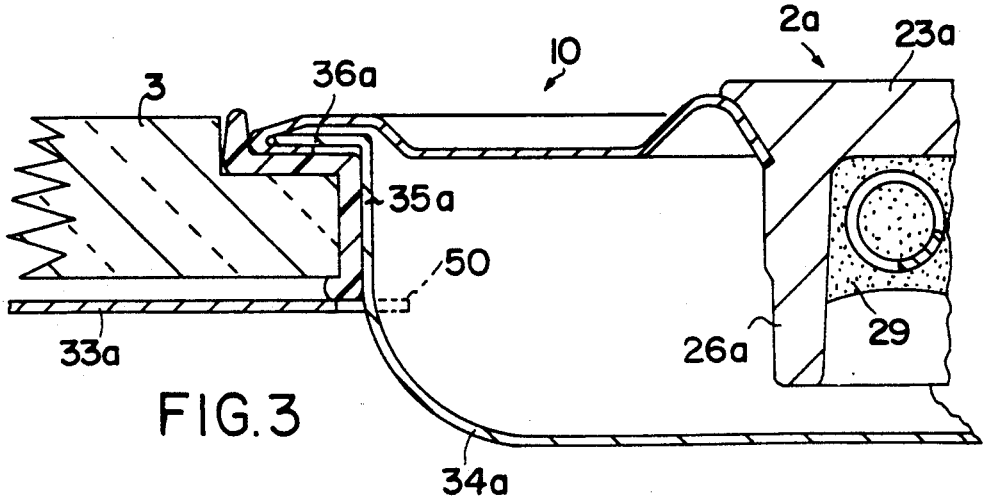
Figure 11:
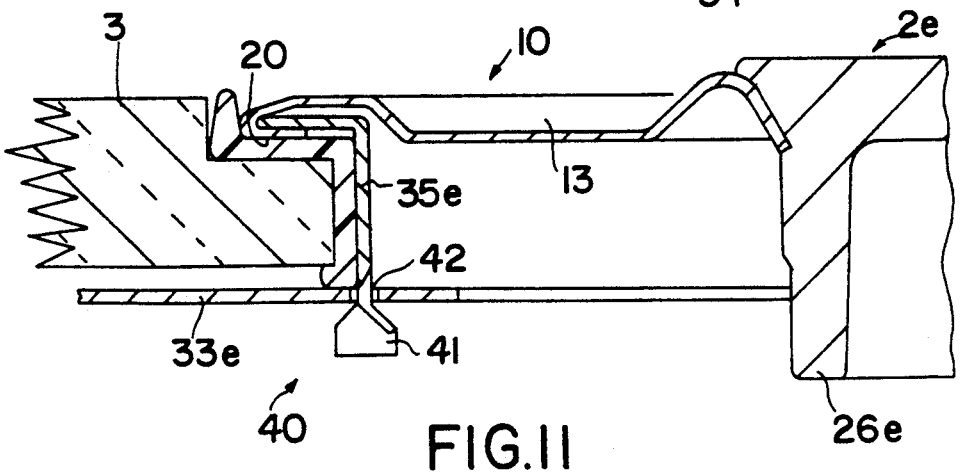

Similar to FIG. 3, the hotplate 2*e* according to FIG. 11 has a relatively low, outer flange edge 26*e* projecting downwards by less than half its height over the mounting plate 3 or the shield plate 33*e*. In the embodiments according to FIGS. 1, 2, 4, 9 and 10 more than half the height of the flange edge projects. The shield casing 35*e* is constructed in similar manner to that of FIG. 2, but is associated with a locking mechanism 40, with which the bearing ring 10 is positively secured against movements at right angles to the mounting plate 3 both upwards and downwards and with its radial outer edge or its support surface 20 is fixed downwards against the mounting plate 3. For this purpose the shield casing 35*e* has locking members 41 projecting downwards in tongue or strip-like manner over its lower ring edge and constructed in one piece therewith and three or more of these can be uniformly distributed over the circumference. The shield plate 33*e* extends radially inwards over and beyond the inner circumference of shield casing 35*e*, so that it engages below the depression 13. In the vicinity of each locking member 41, the shield plate 33*e* has a roughly circumferentially directed, elongated, slot-like locking opening 42 for passing through the associated locking tongue. The latter has a narrower shaft connected to the shield casing 35*e* and a wider head forming the lower end, so that on either side of the shaft the head forms outwardly sloping down locking shoulders. By joggling the locking member 41, said shoulders are braced on the underside of the shield plate 33*e*, so that with increasing joggling the support face 20 is more firmly braced against mounting plate 3. By turning back the head of locking member 41, the locking mechanism 40 can be released again.

Figure 12:
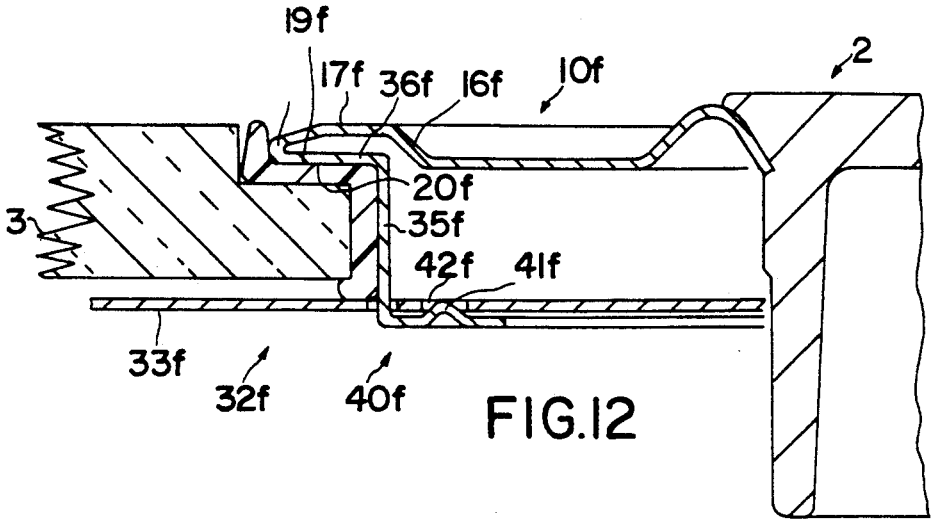

As shown in FIG. 12, the bearing ring 10*f* with the shield casing 35*f* or at least part of the shield 32*f* can also form a closed sheet metal component. Collar 36*f* can be connected by its outer circumferential edge to the bearing ring 10*f* in the vicinity of fold 18*f* and can either be constructed in one piece therewith or can be joined by welding, so that the collar 36*f* forms together with the fold leg 19*f* a common, substantially ring disk-like, planar component and the support surface 20*f* extends approximately up to the outer circumference of the shield casing 35*f*. In the case of correspondingly high downward loading, as in the other embodiments, the edge 17*f* of bearing ring 10*f* can strike against the top of collar 36*f* or shield casing 35*f*, which provides a locking action against excessively deep sagging.

Locking mechanism 40*f* is in this case constructed in the manner of a bayonet locking connection, which can be transferred into the locking position or release position by turning the hotplate 2 or bearing ring 10*f* about the common central axis. At the lower end of the shield casing 35 are bent locking members 41*f* forming inwardly radially projecting bayonet locking cams, with which are associated as locking openings 42*f* bayonet locking openings on the shield plate 33*f*. These locking openings 42*f*, which can e.g. be approximately angular, form in each case with an angle leg or side a correspondingly large insertion opening for the passage of the locking member 41*f* and with the other angle leg or side a circumferentially connecting locking opening portion. The locking member 41*f* and/or the plate bounding the locking opening at the angle inner corner can be given a gradient as a result of which an axial bracing effect is obtained. The locking member 41 can have a shaped out cam for engagement in an opening of the said plate. The hotplate or bearing ring is radially fixed by the locking mechanism.

Figure 13:
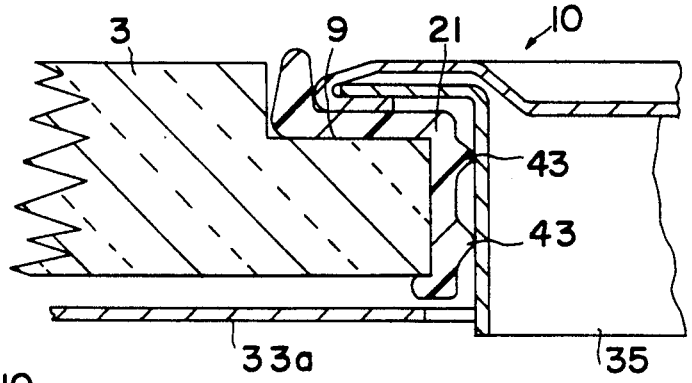
FIGS. 13 to 18 Further embodiments in views corresponding to FIG. 5.

FIG. 13 roughly corresponds to FIG. 2. The profile washer 21 is provided on the inner circumference with two superimposed ring or circular ribs 43 engaging substantially linear under pretension on the outer circumference of the shield casing 35 and provided on the corresponding profile leg below ring shoulder 9. This leads to a much more precisely defined engagement with a higher specific surface pressure.

Figure 14:
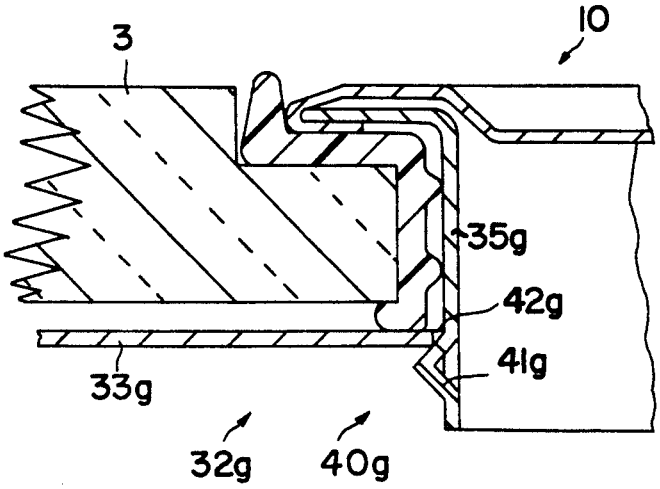

According to FIG. 14 the locking mechanism 40*g* can also be constructed as a snap connection, whose substantially radially resilient locking members 41*g* constructed as snap cams, are shaped in one piece from the shield casing 35*g* and project over its outer circumference. The locking members 41*g* having sloping locking flanks are intended to engage on the underside of shield plate 33*g* in the marginal area of its central passage opening for the casing 35*g*, which in this case forms the locking opening 42*g*. On inserting the bearing ring or hotplate in the mounting plate 3, the locking members 41*g* with their cam tips run up against the inner boundary of the locking opening 42*g*, so that they are resiliently radially inwardly pressed until they spring back radially outwards into the locking position on the underside of shield plate 33*g*.

Figure 15:
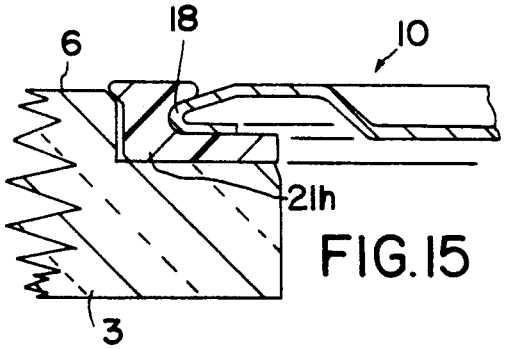

According to FIG. 15 the radially upwardly projecting leg of profile washer 21*h* can also be widened to a head profile in such a way that it engages over the fold 18 of bearing ring 10 in radially inwardly directed manner over at least part of the dropping profile area or even slightly engages over the mounting plate 3 on top 6.

Figure 16:
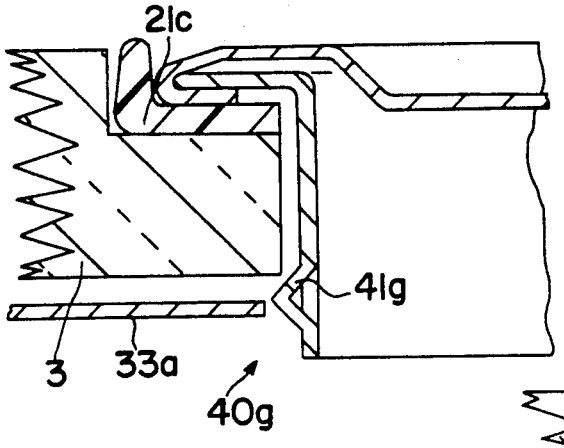
Figure 17:
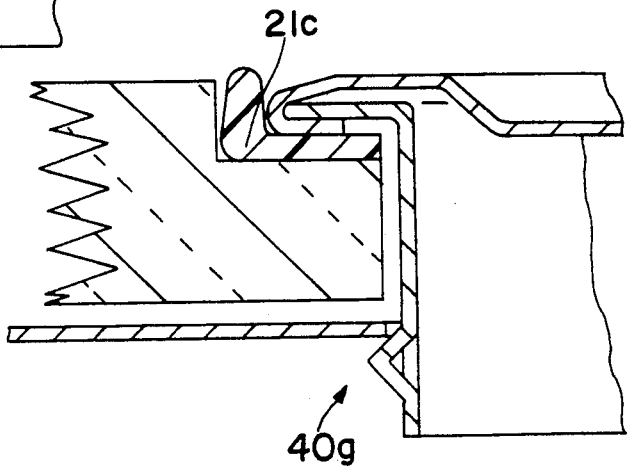

The locking mechanism 40*g* according to FIG. 16 is constructed in essentially the same way as in FIG. 14, but the locking member 41*g* does not engage with shield plate 33*a*, but with the underside of mounting plate 3, a washer 21*c* according to FIG. 5 being provided. Such a washer 21*c* is also provided in the embodiment according to FIG. 17, but the locking mechanism 40*g* is constructed in substantially the same way as in FIG. 14.

Figure 18:
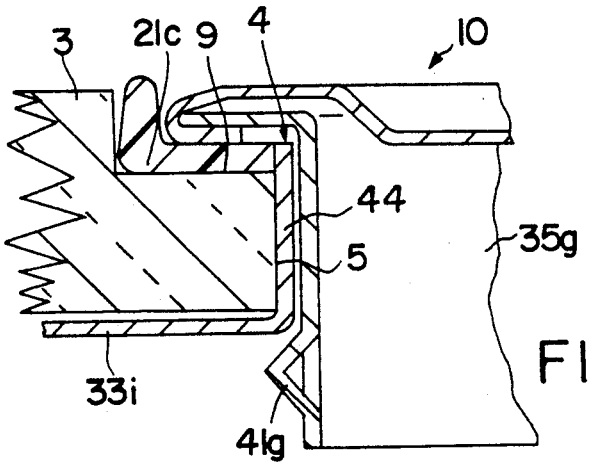

This also applies with regards to the construction of FIG. 18 and, only for ease of viewing reasons, in FIGS. 16 and 18 the locking member is at a limited distance from its mating surface, whereas in fact it engages under pretension on said surface in the assembly state.

In the embodiment according to FIG. 18 the shield plate 33*i* has an upwardly projecting circular flange 44 bounding its central opening and which projects upwards into the mounting opening 4 of mounting plate 3 and can engage in centred manner on its inner circumference 5. In the represented embodiment, the circular flange 44 is extended upwards over and beyond the ring shoulder 9, so that it also engages on the inner circumference of profile washer 21*c*. The circular flange 44, which is immediately adjacent to the outer circumference of shield casing 35*g* and forms a further shield, can be constructed in one piece with shield plate 33*i* or can be formed by a separate component optionally connected by welding to shield plate 33*i*. Its cross-sectionally rounded transition area into the shield plate 39*i* serves as a mating surface for the locking members 41*g*.

Figure 19:
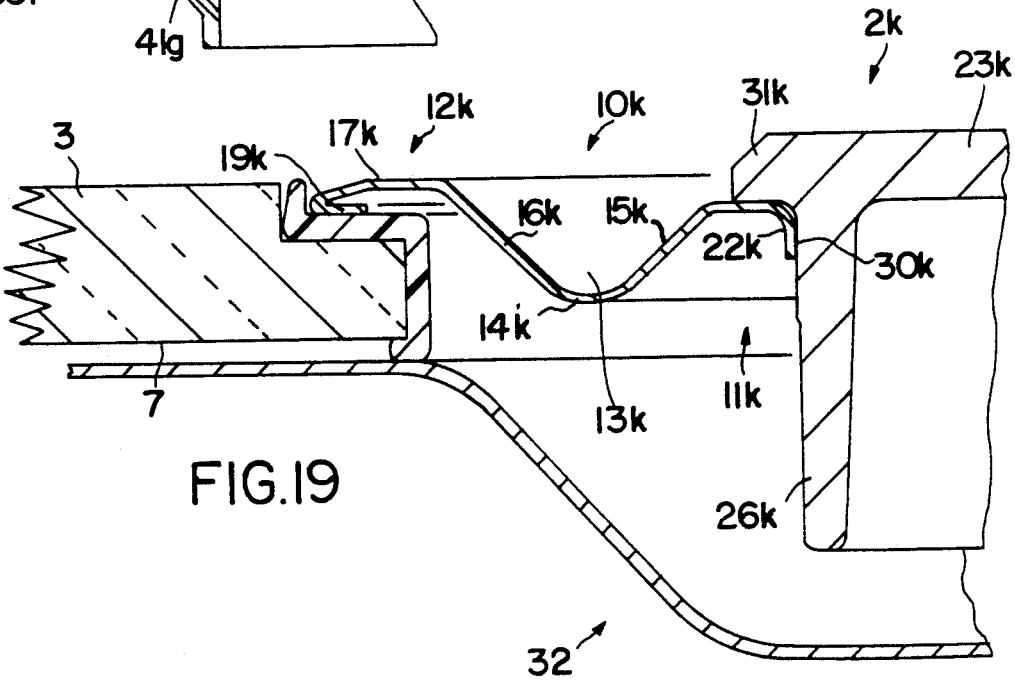

The bearing ring 10*k* according to FIG. 19 is particularly intended for hotplates 2*k* which, in place of a flat ring bead and a frustum-shaped connecting surface in the marginal area, have a reentrant ring shoulder bounded in an approximately right-angled manner and consequently a collar 31*k* projecting radially outwards roughly level with the cooking surface and which is roughly as thick as the plate-like upper part of the hotplate body 23*k* and is located substantially in its plane. For connection to such a hotplate body 23*k*, the bearing ring 10*k* has an inner ring profile 11*k*, which is cross-sectionally approximately angular. A downwardly directed angle leg engages on the outer circumferential surface of flange edge 26*k*, whilst the connected, approximately ring disk-like angle leg engages on the underside of the shoulder surface formed by the collar 31*k*. This angle leg projecting radially slightly outwards over the collar 31*k* passes directly into flank 15*k*.

The central ring profile forms a depression 13*k* bounded cross-sectionally in approximately V-shaped manner, whose bottom 14*k* is rounded in part circular manner and passes tangentially into both flanks 15*k*, 16*k*. The bottom 14*k* of the relatively deep collecting channel is positioned above the bottom 7 of mounting plate 3 and above the bottom of the insulating material receiving the heating resistors, but below the support surface and the centre of the thickness of mounting plate 3. Thus, hotplate 2*k* can sink relatively deeply in resilient manner without there being any risk of liquid collected in depression 13*k* flowing back onto the cooking surface. As the inner ring profile 11*k* is slightly deeper than the outer ring profile 12*k* or edge 17*k*, there could be a risk of liquid passing under bearing ring 10*k* between ring profile 11*k* and hotplate body 23*k*, which is virtually excluded by the relatively large capacity of the depression 13*k*. The engagement of ring profile 11*k* on hotplate body 23*k* is appropriately such that a liquid-tight connection is obtained.

Figure 20:
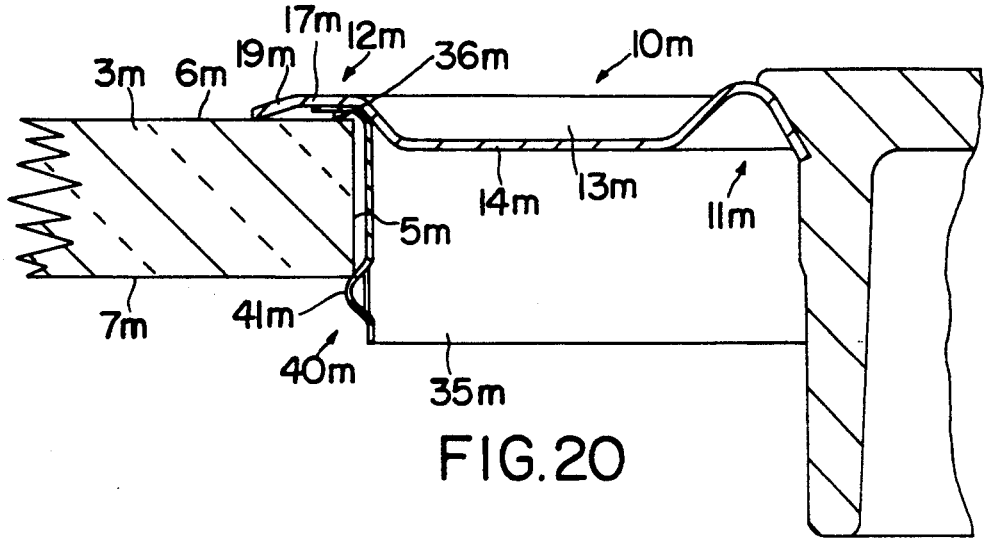

As shown in FIG. 20, the mounting plate 3*m* can also have a constant thickness up to the inner circumference 5*m* of the mounting opening, so that there is no need for a stepped ring shoulder and the inner circumference 5*m* passes with the same width over the entire thickness of mounting plate 3*m*. In this case the outer ring profile 12*m* appropriately has no inwardly directed fold leg and is instead constructed in one-layer form in its radially outermost region, so that its circumferential edge face formed by a cutting edge engages with a sharp ring edge on the top 6*m* of the mounting plate 3*m* under pretension. This ring edge is appropriately formed by a radially outwardly sloping away or obtuse-angled, frustum-shaped ring edge, which is connected to the ring disk-like rim 17*m* and keeps the same at a limited distance below top 6*m*. The central ring profile forming the depression 13*m* and the radially inner ring profile 11*m* are constructed substantially identically to FIG. 1.

The shield casing 35*m* is in this case so fixed by its collar 36*m* to the underside of rim 17*m*, e.g. by spot welding, that it has a limited spacing from the top 6*m* of mounting plate 3*m* and consequently there is a smaller, stop-limited spring deflection. The locking mechanism 40*m* has e.g. bead-like, resilient locking members 41*m* shaped in radially outwardly directed manner from the shield casing 35*m* and which engage behind the mounting plate 3*m* on underside 7*m* adjacent to inner circumference 5*m*. Over most of its length the shield casing 35*m* has no contact with the inner circumference 5*m* or mounting plate 3*m*, so that a thermal insulation gap optionally ventilated from the bottom is formed.

Figure 21:
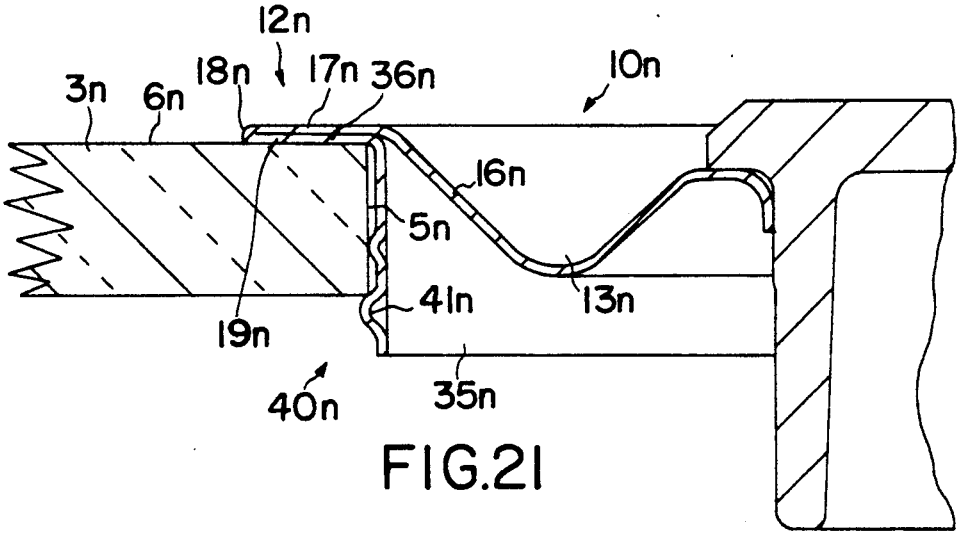

Much the same occurs with the embodiment according to FIG. 21, in which in addition to the locking member or members 41*n* on shield casing 35*n* is provided at least one cam or ring bead for engagement on inner circumference 5*n*. The outer ring profile 12*n* of the bearing ring 10*n* is in this case constructed in double-layer form, so that two ring disk-like sheet metal layers engage on one another in a substantially whole-surface manner. The upper layer forms the rim 17*n* and the lower layer the fold leg 19*n*, as well as the collar 36*n* of shield casing 35*n*. The lower layer engages in substantially whole-surface manner on the top 6*n* of the mounting plate and extends approximately to the transition of rim 17*n* into flank 16*n* of depression 13*n*.

Figure 22:
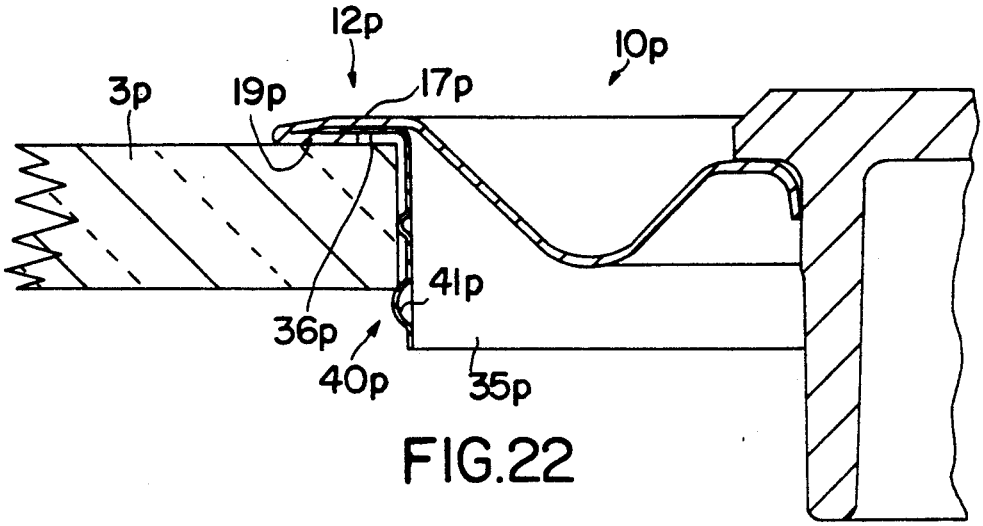

According to FIG. 22 the outer ring profile 12*p* substantially corresponds to that of FIG. 2. Unlike in the embodiment according to FIG. 2, the collar 36*p* or the shield casing 35*p* is not made from sheet metal material having substantially the same thickness as the bearing ring 10*p*, but from a much thinner metal sheet, which can have in the manner of a spring sheet a sharply rising spring characteristic and is appropriately only a few tenths of a millimeter thick. The locking mechanism 50*p* with spacers for the inner circumference of the mounting plate 3*p* corresponds to that of FIG. 21.

Figure 23:
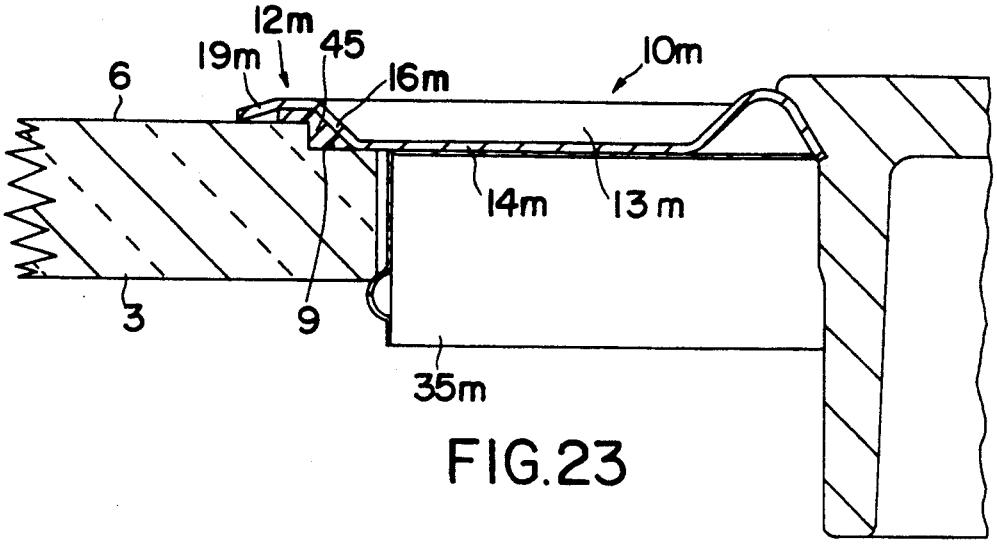

The bearing ring 10*m* according to FIG. 23 essentially corresponds to that of FIG. 20. Mounting plate 3 is provided with a stepped ring shoulder, on which directly rests the bearing ring 10*m* also with its central ring profile, namely with the outer area of the bottom 14*m* of depression 13*m* connected to flank 16*m*. The outer ring edge 19*m* engages over this ring shoulder 9, which is narrower and shallower than in FIG. 1 and, much as in FIG. 20, rests on the top 6 of mounting plate 3. Thus, a stepped or correspondingly profiled ring gap is formed between ring shoulder 9 and top 6 on the one hand and flank 16*m* and outer ring profile 12*m* on the other and this is at least partly filled with a sealing adhesive 45. The shield casing 35*m* can engage with a collar on ring shoulder 9 or can be fixed in the manner of a collar-free sleeve by its upper end to the bottom of bearing ring 10*m*, particularly to the bottom 14*m* by welding or the like.

Figure 24:
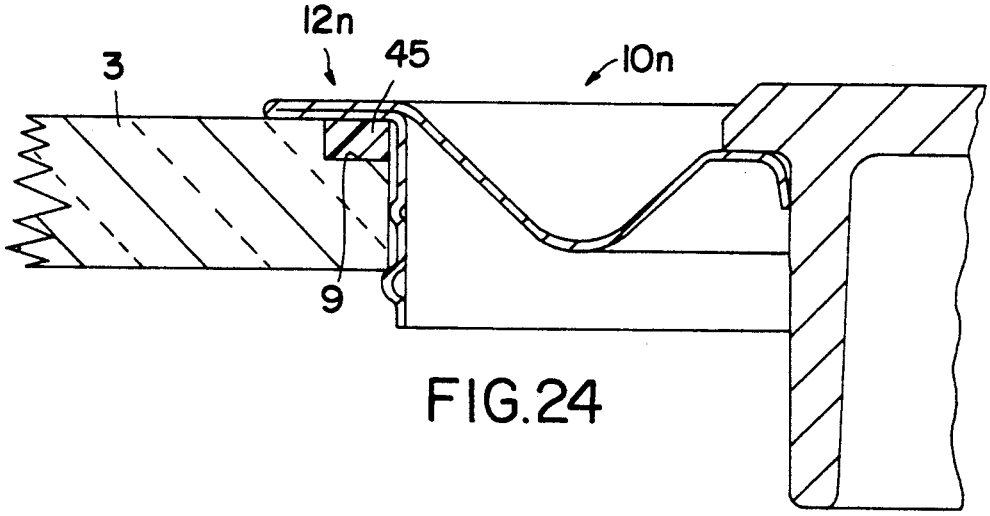

The bearing ring 10*n* according to FIG. 24 corresponds to that according to FIG. 21, but the mounting plate 3 has a narrower or roughly half as narrow ring shoulder 9 compared with the outer ring profile 12n and is filled with the adhesive 45 or the washer or seal.

Figure 25:
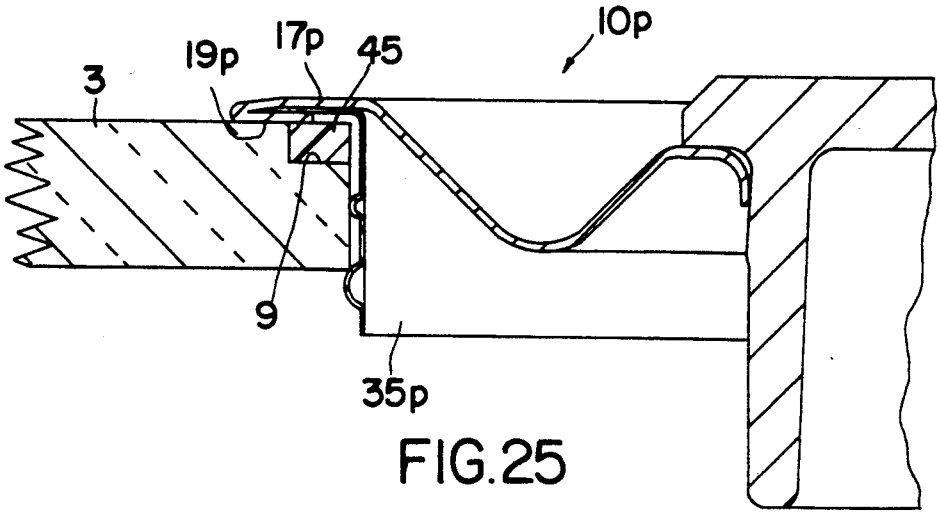

Including shield casing 35p, the bearing ring 10p according to FIG. 25 corresponds to that of FIG. 22, but here again the mounting plate 3 is provided with a ring shoulder 9 for receiving adhesive 45 or the like. The fold leg 19p only extends over an outer part of the width of adhesive 45, so that it is exposed in the radially inner area, optionally for the elastic engagement of rim 17p.

As shown in FIGS. 26 and 27, the mounting plate 3r can also be constructed in one piece with shield 32r from sheet metal or some other appropriate material. For example the shield dish 34r with its shield casing 35r are directly shaped on to the mounting plate 3r. The bearing ring 10r, apart from with its outer ring edge 19r, engages with radial spacing on the top of the mounting plate 3r, preferably on the transition between the latter and the shield casing 35r in centring manner, so that there is a very simple orientation of hotplate 2r relative to the mounting opening. Shield 32r is constructed in one piece with the centring means 38r which, in this embodiment, forms four short centring members uniformly distributed over the circumference and whose ends are located directly adjacent to the outer circumference of flange edge 26r. Two further variants are indicated below shield 32r in FIG. 26, the upper one forming on the lower end of the shield casing an inwardly bent, narrow collar located at a relatively large distance from the flange edge 26r, whilst the lower one has a shield casing, which is also open to its full width at the bottom end, which gives a relatively good ventilation below the bearing ring 10r.

According to FIG. 28 the shield 32s can also completely receive the hotplate 2s, in such a way that the bottom of the shield dish 34s is positioned directly below the flange edge 26s. The shield dish 34s has a cross-sectionally curved dish bottom, which is concave at the top and whose radius of curvature decreases radially outwards, so that the mounting plate 3s is stiffened and can therefore be made from very thin material. Bearing ring 10s essentially corresponds to that of FIG. 20.

The outer ring profile 12t of bearing ring 10t according to FIG. 29 is similar to FIG. 1. The fold leg 19t is located directly on the top of the mounting plate 3t. The latter passes via a conical intermediate portion 9t into shield casing 35t. The conicity of the intermediate portion 9t corresponds to that of flank 16t of bearing ring 19t, so that said flank 16t can engage on intermediate portion 9t centred in large-surface manner.

Figure 30:
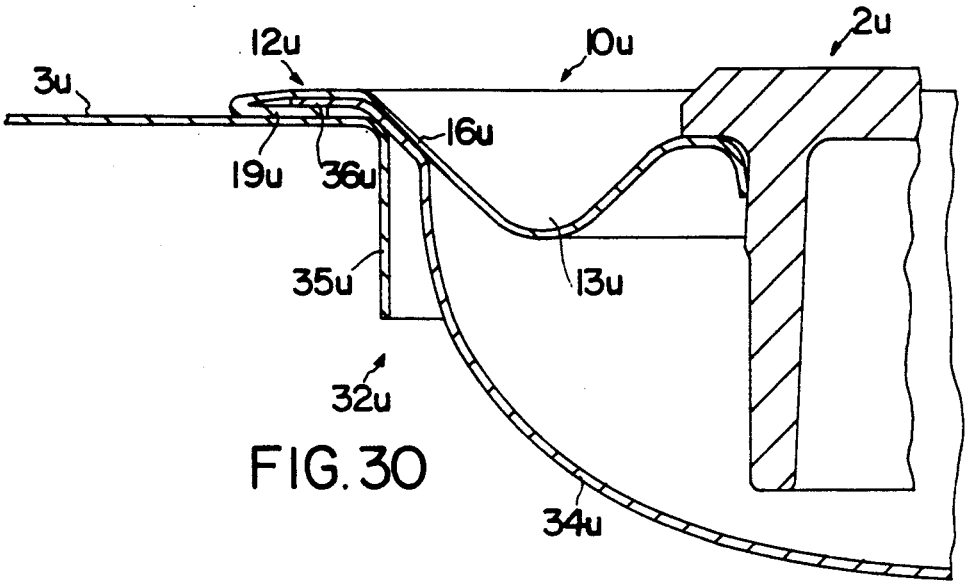

In the embodiment according to FIG. 30 there are once again two or three spaced, telescoped shield parts for shield 32u. The innermost shield part is formed by the central ring profile of bearing ring 10u, namely by the boundaries of depression 13u. The outermost shield part is constructed as a shield casing 35u in one piece with the mounting plate 3u and the central shield part is formed by the shield dish 34u, whose collar 36u is inserted in the outer ring profile 12u of bearing ring 10u. Collar 36u passes via a conical intermediate portion into shield dish 34u. The intermediate portion engages on the one hand at the transition between the shield plate 3u and the shield casing 35u and on it is supported on the other hand the flank 16u in the manner described relative to FIG. 29.

Figure 31:
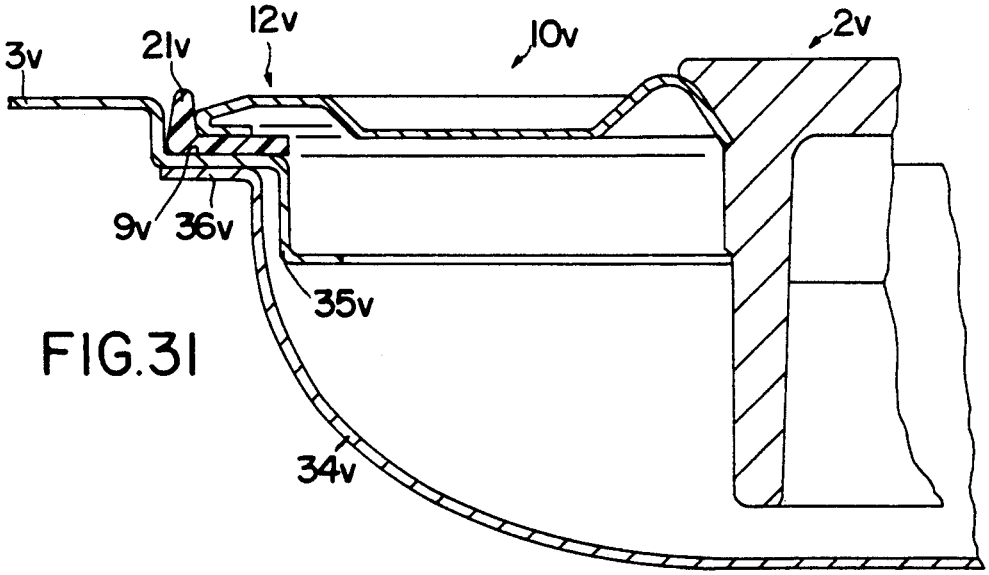

According to FIG. 31 the sheet metal mounting plate 3v forms a ring shoulder 9v for receiving the angular profile washer 21v and the outer ring profile 12v of bearing ring 10v as a result of a corresponding shaping thereof. The bottom part of ring shoulder 9v passes into a shield casing 35v, much as in the second variant of FIG. 26. The outer circumference of shield casing 35v is surrounded by a further shield part, namely the casing of shield dish 34v, whose collar 36v is fixed to the underside of the bottom part of ring shoulder 9v, e.g. by spot welding, so that by a double-layer construction of said bottom part, there is a correspondingly locally limited stiffening.

Figure 32:
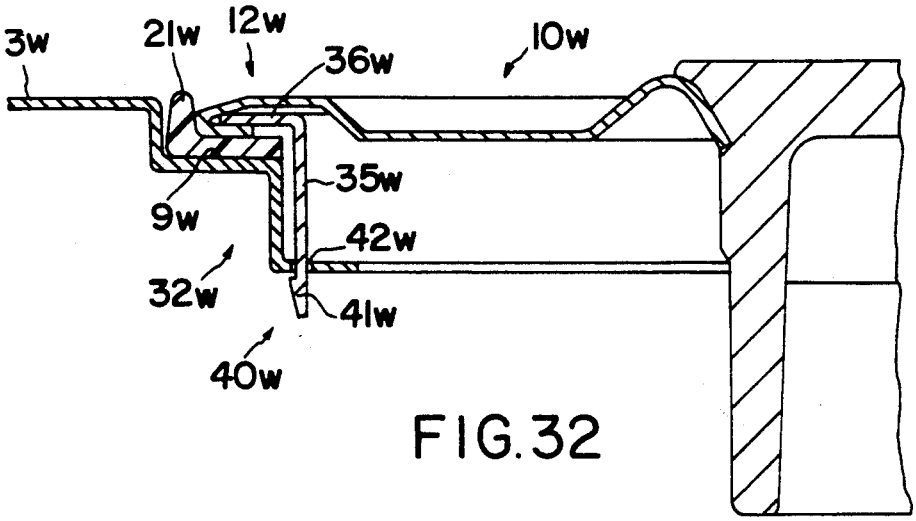

The mounting plate 3w according to FIG. 32 is constructed in much the same way as in FIG. 31 in the vicinity of the mounting opening. However, within the casing part connected at the bottom to the ring shoulder 9w, there is a further shield casing 35w, whose collar 36w is inserted in the outer ring profile 12w of bearing ring 10w. Thus, with the shield casing 35w can be associated a locking mechanism 40w constructed in the manner of a self-locking snap connection, which appropriately has hook-like bolts as the locking members 41w and with which are associated in an inwardly directed collar of the casing part of the mounting plate 3w, locking openings 42w.

Figure 33:
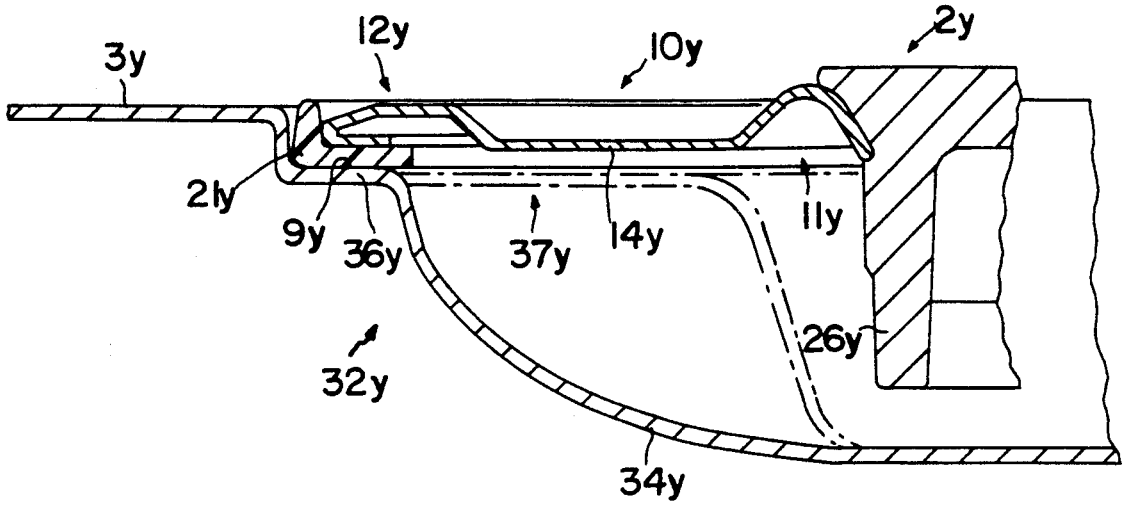

In FIG. 33 the shield 42y is constructed in much the same way as in FIG. 28. In the transition area between the casing of shield dish 34y and the useful part of the mounting plate 3y is provided a recessed ring shoulder 9y for receiving the outer ring profile 12y of bearing ring 10y. The width of ring shoulder 9y can be smaller than that of ring profile 12y or slightly larger than that of the support surface. As indicated by dot-dash lines in FIG. 33, it can also engage below the bottom 14y over at least part of its width or with limited spacing approximately up to the inner ring profile 11y and only adjacent to the outer circumference of ring flange 26y does it pass into the dish jacket. This leads to a support part 37y directly connected to the mounting plate 3y or constructed in one piece therewith.

Figure 34:
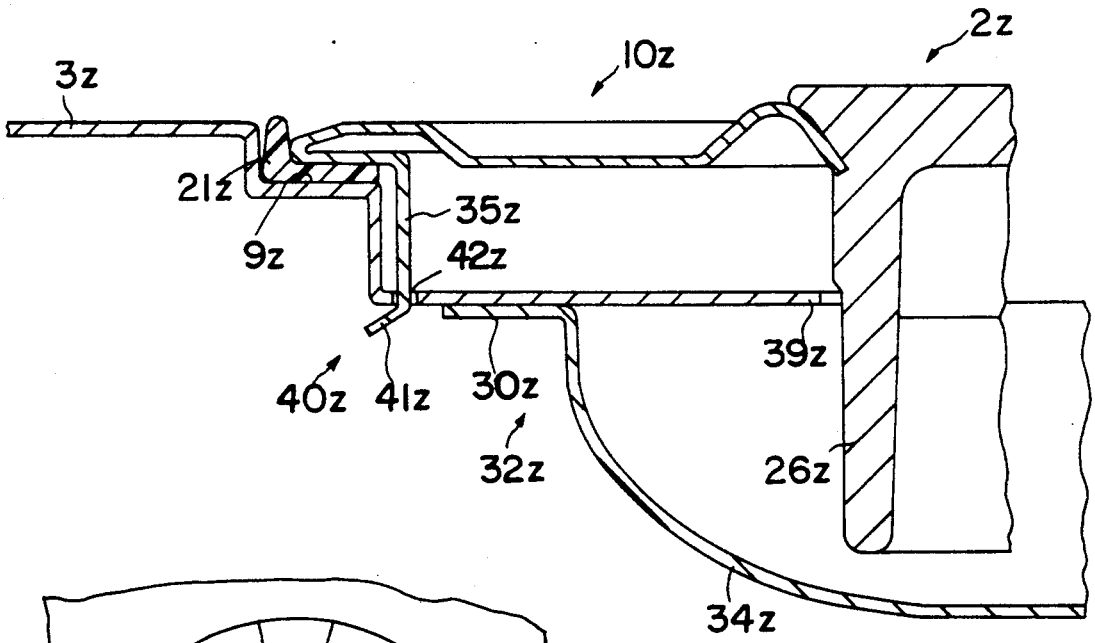
Figure 35:
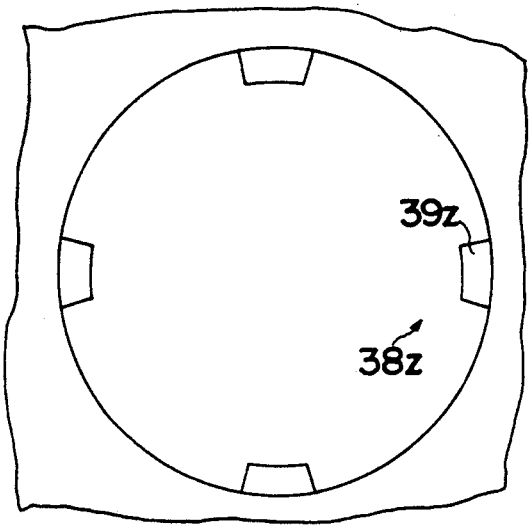
FIG. 35 A detail of FIG. 34 in a view from below.

According to FIGS. 34 and 35 there are two spaced, superimposed, cup-shaped or dish-shaped shield areas or parts, whereof the upper one is connected by its casing directly to the ring shoulder 9z. Collar 36z of the lower shield dish 34z is connected to the bottom of the upper shield part, namely at a distance within its outer circumference to its underside. In the upper area of shield 32z connected to bearing ring 10z there are two substantially coaxial telescoped shield parts. The outer one is formed by the casing of the upper, cup-shaped shield part and the inner one by a shield casing 35z, which is connected to bearing ring 10z as described relative to FIG. 4. At the lower end shield casing 35z forms bending tongues as locking members 41z, which immediately adjacent to the outer circumference of collar 36z pass through locking openings 42z in the bottom of the upper, cup-shaped shield part and are bent below said bottom for locking purposes. A centring means 38z with centring members 39z similar to FIGS. 26 and 27 is formed by the bottom of the upper, cup-shaped shield part, which is slightly above the centre of the height of flange edge 26z.

In FIGS. 1 to 35 corresponding parts are given the same reference numerals, but followed by different reference letters, so that corresponding description parts apply to all the relevant drawings. The individual ring profiles of the bearing rings and parts thereof can be randomly combined in other embodiments, which leads to further embodiments. This also applies with regards to the mounting plate, which can be e.g. assembled from the described glass ceramic and sheet metal parts in the vicinity of the ring shoulder, for the described parts of the shields, the centring and locking devices and the profile washers. As the bearing ring is constructed in one piece from its radial innermost boundary or its transition into the hotplate body and up to its radial outermost boundary, a through, smooth-surface and edge-free, but profiled bearing ring top is obtained as a connection between the outer circumference of the hotplate body and the mounting ring, so that despite the formation of a depression there is no need for joints, openings, etc., whilst the cooking surface still only projects by roughly 1 to 2 mm above the top of the mounting plate or can even be roughly in the plane of the top of the mounting plate. Thermal expansions and expansion deformations are reversibly absorbed by the bearing ring. Apart from the shield between the hotplate body and the mounting plate, the bearing ring forms a heat radiator, so that e.g. in the case of a temperature of approximately 400° C. in the vicinity of the hotplate body, in the vicinity of the mounting plate the temperature is only roughly half as high, e.g. 200° C. The bearing ring can form the sole support of the hotplate with respect to the mounting plate.

The inventive construction is advantageously also suitable for earthing the bearing ring, the centring or shield casing and/or other metal components outside the hotplate body. FIG. 1 shows an earthing part 46, e.g. formed by a sheet metal strip, which in not shown manner is electrically conductively connected to the earthed hotplate body 23 by being screwed to its centre stud. On the underside of the hotplate body 23, earthing part 46 is guided radially to its outer circumference and is electrically conductively connected there to the bearing ring 10 by means of at least one earthing lug 47 or 48 constructed in one piece therewith and also indicated in dot-dash line manner. The strip or tongue-like earthing lugh 47 slopes upwards to the outer ring profile 12 of bearing ring 10 from the underside of the outer flange edge 26 and is connected thereto optionally in the same way as illustrated relative to collar 36 in FIG. 2. Instead of this or in addition thereto, the earthing lug 48 can also be led upwards along the outer circumference of flange edge 26 and can be connected to bearing ring 10 in the vicinity of the inner ring profile 11. The earthing lug 48 can be constructed in one piece with the bearing ring 10 in that it forms an extension of its connecting leg 22. If the bearing ring 10 is punched in circular manner from sheet metal, then it requires no additional material for lug 48, because it can be shaped from the punching waste punched out for forming the ring opening.

As shown in FIG. 1, in place of this or in addition thereto there can also be an earthing lug 49 for earthing shield 32. This earthing lug 49, whose one end is also connected in the described manner to the outer ring profile 12 and which can be guided downwards along washer 21, traverses the shield plate 33 in the vicinity of an opening adapted thereto and is bent radially outwards below plate 33 and is fixed by e.g. a screw by the resulting leg formed to the underside of the shield plate 33. Due to the positive engagement of the earthing lug 49 in shield 32 in the circumferential direction of hotplate 2, as well as due to its rigid connection to the bearing ring 10, the earthing lug 49 simultaneously prevents the rotation of ring 10 or hotplate 2 with respect to the shield 32, mounting depression and mounting plate 3. It is also conceivable to distribute two or more such earthing lugs 49 or rotation preventing means in a substantially uniform manner over the circumference of bearing ring 10 or hotplate 2.

FIG. 2 shows in dot-dash line form an earthing lug **49*a*, which is fixed by an upwardly directed leg to the inner circumference of the shield casing 35, e.g. by spot welding, whilst its other leg is fixed to the underside of shield plate 33*a* with a screw or the like. This earthing lug 49*a* can also be constructed in one piece with the shield casing 35, so that it passes out from its lower ring edge. Moreover, in addition to this or in place thereof, to the shield casing 35 or shield plate 33*a* can be connected an earthing lug, which passes along the underside of the hotplate body and, as explained relative to earthing part 46, is electrically conductively connected to the hotplate body. This earthing lug can also be connected by spot welding to the inner circumference of shield casing 35 or shield plate 33*a***.

The said rotation prevention means need not be constructionally combined with an earthing lug and can, as shown in FIG. 1, also be in the form of an angular member, whose shape corresponds to the cross-section of shield casing 35 shown in FIG. 2. The upper leg of said member is then connected to the bearing ring 10, whilst the downwardly directed leg, which is substantially linear to its lower end, traverses the shield 32 in the described manner. For rotation prevention purposes, on the shield plate **33*a* can be provided a projecting rotation preventing member 50, which is appropriately constructed in one piece with the shield plate and is indicated in dot-dash form in FIG. 3. The one or more circumferentially distributed members 50 engage roughly radially inwardly projecting in an opening in the shield casing or pot. This not shown opening is appropriately closely adapted circumferentially to the rotation preventing member 50. In plan view of the hotplate or in the direction in which it is to be inserted in mounting plate 3, said opening is appropriately sufficiently large that it projects over the free end of the rotation preventing member 50. This can be simply achieved in that the opening is correspondingly extended from the top of member 50 in the downwards direction into the rounded transition zone between the shield casing 35*a* and the bottom of shield pot 34*a*. Thus, the rotation preventing member 50 and the associated locking opening can be engaged and disengaged by a relative movement roughly at right angles to mounting plate 3. In the construction according to FIG. 2 such a tongue-like rotation preventing member would engage in a centring opening of the shield casing 35, which emanates from its lower longitudinal edge. Rotation prevention means much as in FIG. 1 are also provided in the embodiments according to FIGS. 11, 12, 32 and 34** and are also conceivable in the other embodiments, which is also the case with regards to the earthing described.

We claim:

1. An electric hotplate comprising:

a hotplate body having a cooking surface defining a setting plane on a topside of said hotplate body; a bearing ring determining, on an underside with a support face, a support plane for support on an opening rim of a mounting plate provided to receive said hotplate and to define a standing plane on an upper side, said bearing ring passing in substantially a one-part form between the hotplate body and the support face and being fixedly connected to said hotplate body, said bearing ring having, between the hotplate body and the support face, a circumferentially extending, substantially circular collecting depression laterally bounded by inner and outer flanks determining inner and outer apexes of said bearing ring, wherein said inner apex is located above said outer apex.

2. The electric hotplate according to claim 1, wherein said bearing ring has a radially inner inside ring profile for connecting to the hotplate body and a radially outer outside ring profile providing said support face, said inside ring profile providing said inner apex and said outside ring profile providing said outer apex.

3. The electric hotplate according to claim 1, wherein a bottom wall of said collecting depression is connected to said flanks, said inner flank being higher than said outer flank.

4. The electric hotplate according to claim 1, wherein said collecting depression has a width extension between more than twice and five times of a depth extension of said collecting depression.

5. The electric hotplate according to claim 1, wherein said collecting depression is cross-sectionally shaped in a flat dish-like manner, said collecting depression having a substantially continuously planar bottom wall connecting to at least one of said flanks at an angle between 135 degrees and 165 degrees.

6. The electric hotplate according to claim 1, wherein said bearing ring in the vicinity of a deepest zone of said collecting depression extends between at the most up to a plane of an underside of said mounting plate and half of a height extension of said hotplate body.

7. The electric hotplate according to claim 1, wherein said collecting depression is bounded by shallowly rising flanks located at an angle of substantially 45 degrees.

8. The electric hotplate according to claim 1, wherein within a mounting opening receiving said hotplate body is provided at least one further support for supporting said bearing ring with respect to said mounting plate on an underside of said bearing ring.

9. The electric hotplate according to claim 8, wherein said further support is supportingly in contact with at least one of zones provided by a bottom and a flank of the collecting depression.

10. The electric hotplate according to claim 1, wherein said bearing ring has an outer annular support profile connecting to said outer flank and providing said support face, said support profile having an upper substantially planar surface descending radially outwardly at a shallow angle of only a few radians and providing an outer circumferential edge resting against said upper side of said mounting plate.

11. An electric hotplate comprising:

a hotplate body having a cooking surface defining a setting plane on a topside of said hotplate body; a bearing ring determining, on an underside with a support face, a support plane for support on an opening rim of a mounting plate provided to receive said hotplate and to define a standing plane on an upper side, said bearing ring passing in substantially a one-part form between the hotplate body and the support face, said bearing ring being associated with at least one position locking mechanism having at least one locking member connected to said bearing ring and at least one counter member for receiving said locking member and locking said bearing ring against raising from said mounting plate, wherein at least one of said at least one counter member is a sheet material plate located below said mounting plate and extending radially inwardly beyond said mounting rim.

12. The electric hotplate according to claim 11, wherein at least one of said at least one locking member is constructed substantially as a one-part component of said bearing ring.

13. The electric hotplate according to claim 11, wherein said bearing ring is fixedly connected to said hotplate body and at least one of said at least one locking member is at least one of members provided by a resilient snap member, a bending tongue and a locking cam.

14. The electric hotplate according to claim 11, wherein at least one of said at least one counter member is located substantially below an underside of said mounting plate and radially inside of a mounting opening receiving said hotplate body.

15. The electric hotplate according to claim 1 or 11, wherein said bearing ring is constructed in an at least double-layer form in the vicinity of said support face, layers of said double-layer form being connected in one part with each other.

16. The electric hotplate according to claim 15, wherein a lower ring layer of said bearing ring passes into a downwardly projecting collar section located on an outside of an annular flank of said bearing ring and in a mounting opening receiving said hotplate.

17. The electric hotplate according to claim 15, wherein between a lower ring layer and an upper ring layer said bearing ring receives an outwardly directed upper flange of a downwardly directed collar section located on an inside of a mounting opening receiving said hotplate.

18. The electric hotplate according to claim 16, wherein at least one locking member is a one-part component of said collar section.

19. The electric hotplate according to claim 1 or 11, wherein a thermal shield is provided between an inner circumference of a mounting opening of said mounting plate and said hotplate, said shield being fixedly directly connected with said bearing ring.

20. The electric hotplate according to claim 19, wherein said thermal shield provides at least one locking member for locking said bearing ring with respect to said mounting plate.

21. An electric hotplate comprising:

a hotplate body having a cooking surface defining a setting plane on a topside of said hotplate body; a bearing ring determining, opposite to a top side on an underside with a support face a support plane for support on an opening rim of a mounting plate provided to receive said hotplate and to define a standing plane on a upper side, said bearing ring passing in substantially a one-part form between the hotplate body and the support face, said support face being radially spaced from said hotplate body, wherein said mounting plate has a recessed ring shoulder for receiving said support face of said bearing ring, on a radially outer portion said top side of said bearing ring being located substantially in said standing plane and forming an even continuation of said upper side of said mounting plate.

22. The electric hotplate according to claim 21, wherein said ring shoulder has a depth extension smaller than a thickness extension of said mounting plate.

23. The electric hotplate according to claim 21, wherein said recessed ring shoulder is provided for receiving a profile ring washer for supporting said bearing ring, said ring washer extending at the most up to said standing plane.

24. The electric hotplate according to claim 23, wherein said ring washer substantially and angularly lines said recessed ring shoulder with profile webs at angles to each other.

25. The electric hotplate according to claim 23 or 24, wherein below said standing plane said ring washer substantially covers an edge face of at least one of members provided by said mounting plate and said bearing ring.

26. The electric hotplate according to claim 1, 11 or 21, wherein for at least one of zones provided by an outer circumference of said hotplate, an underside of said mounting plate and an underside of said hotplate is provided at least one thermal shield borne by a radially outer flange of said bearing ring.

27. The electric hotplate according to claim 26, wherein said shield provides a component for downwardly tensioning said bearing ring against said mounting plate.

28. The electric hotplate according to claim 1, 11 or 21, wherein at least one shield for an underside of said hotplate (2 or 2*z*) is constructed as a shield dish (34 or 34*z*).

29. The electric hotplate according to claim 28, wherein said shield dish substantially at least extends to an underside of a component forming said mounting plate (3 or 3*z*).

30. The electric hotplate according to claim 1, 11, or 21, wherein at least one shield (32) is formed as a component separate from said hotplate (2), said component passing in substantially one-part form and as a closed component below said hotplate (2) and said mounting plate (3).

31. The electric hotplate according to claim 1, 11, or 21, wherein between said support face (20) substantially connected to an outer circumference and said hotplate (2) at least one additional support is provided for the bearing ring (10).

32. The electric hotplate according to claim 31, wherein said additional support is formed by at least one upwardly projecting support section (37) of a shield (32*d*).

33. The electric hotplate according to claim 1, 11, or 21, wherein at least one shield (32*y*) for said hotplate (2*y*) is constructed substantially in one part with said mounting plate (3*y*) from sheet metal.

34. The electric hotplate according to claim 1, 11, or 21, wherein at least one shield for an underside of said hotplate (2*a*) forms a substantially one-part component with a casing part traversing said mounting opening and connected to said bearing ring.

35. An electric hotplate comprising:

a hotplate body having a cooking surface defining a setting plane on a topside of said hotplate body; a bearing ring determining, on an under side with a support face, a support plane for support on an opening rim of a mounting plate provided to receive said hotplate and to define a standing plane on an upper side, said bearing ring passing in substantially a one-part form between the hotplate body and the support face, wherein for centering said hotplate with respect to said mounting plate is provided at least one centering member engaging an outer circumference of said hotplate body at a distance below said bearing ring.

36. The electric hotplate according to claim 35, wherein said centring member (39*r*) is directed against an outer circumference of an outer flange edge (26*r*) of said hotplate body.

37. The electric hotplate according to claim 35, wherein said centring member is shaped out of a shield (32*r*) for said hotplate.

38. The electric hotplate according to claim 35, wherein a plurality of circumferentially distributed centring members (39*r*) is provided, each centring members forming on freely projecting centring tongue.

39. The electric hotplate according to claim 1, 11, 21, or 35, wherein said setting plane of said hotplate is arranged substantially only between one and less than five millimeters above said standing plane of said mounting plate.

40. The electric hotplate according to claim 1, 11, 21, or 35, wherein an inner ring profile of said bearing ring has two downwardly projecting profile legs and forms a highest area of said bearing ring, one of said profile legs being a flange for direct connection to said hotplate body, said inner ring profile being surrounded by an outer ring profile providing said support face.

41. The electric hotplate according to claim 1, 11, 21, or 35, wherein said mounting plate (3 or 3*s*) is at least partly formed by a solid plate at least partly made from at least one of materials provided by a non-metallic material, wood, glass, ceramic and sheet metal.

42. The electric hotplate according to claim 1, 11, 21, or 35, wherein said bearing ring is at least partly secured to the mounting plate against upward displacement by bonding of said support face connecting to a peripheral circumference of said bearing ring as a substantially planar ring disk-like surface.

43. The electric hotplate according to claim 42, wherein between an outer ring profile of said bearing ring and said mounting plate is provided an adhesive, said outer ring profile surrounding an inner ring profile having two spaced profile legs.

44. The electric hotplate according to claim 1, 11, 21, or 35, wherein for at least one of members provided by said hotplate and said bearing ring is provided a rotation prevention means substantially made of sheet material and surrounding said hotplate body.

45. The electric hotplate according to claim 44, wherein at least one of said members is rotationally secured with respect to a shield located below said mounting plate.

46. The electric hotplate according to claim 45, wherein a locking member connected in non-rotary manner to the bearing ring engages a rotation preventing member made in one part with said shield forming a plate.

47. The electric hotplate according to claim 1, 11, 21, or 35, wherein an earthing part is fixed by a substantially welding-like joint directly to at least one of members provided by said bearing ring and a shield extending below said mounting plate.

48. The electric hotplate according to claim 47, wherein at least one earthing lug is electrically conductively connected to at least one of members provided by an outer circumference of said hotplate body and an underside of said shield.

49. The electric hotplate according to claim 1, 11, 21, or 35, wherein said hotplate body has an upper, plate-like portion bounded by said setting plane and a lower boundary plane and provided with a downwardly projecting flange, said bearing ring being entirely located substantially within said setting plane and said boundary plane.

50. The electric hotplate according to claim 49, wherein adjacent to an underside of said plate-like portion is provided a heating resistor, said underside defining said lower boundary plane.

51. An electric hotplate comprising:

a hotplate body having a cooking surface defining a setting plane on a topside of said hotplate body; a bearing ring determining, on an underside with a support face, a support plane for support on an opening rim of a mounting plate provided to receive said hotplate and to define a standing plane on an upper side, said bearing ring passing in substantially a one-part form between the hotplate body and the support face, said bearing ring being associated with at least one position locking mechanism with at least one locking member for locking said bearing ring against raising from said mounting plate, wherein for at least one of zones provided by an outer circumference of said hotplate, an underside of said mounting plate and an underside of said hotplate is provided at least one shield, said shield being traversed by a locking member for said bearing ring.

* * * * *